US006622860B2

(12) United States Patent
Horbal

(10) Patent No.: US 6,622,860 B2
(45) Date of Patent: Sep. 23, 2003

(54) UNIVERSAL PACK APPARATUS AND METHOD

(76) Inventor: John Alexander Horbal, 805 Cashew La., Cedar Park, TX (US) 78613

( * ) Notice: Subject to any disclaimer, the term of this patent is extended or adjusted under 35 U.S.C. 154(b) by 121 days.

(21) Appl. No.: 09/912,871

(22) Filed: Jul. 25, 2001

(65) Prior Publication Data

US 2003/0019779 A1 Jan. 30, 2003

(51) Int. Cl.[7] ..... B65D 85/00

(52) U.S. Cl. ..... 206/320; 206/591; 53/456; 53/461; 229/101; 229/103.2

(58) Field of Search ..... 206/305, 320, 206/424, 449, 454, 476, 477, 482, 521, 525, 525.1, 701, 591, 592, 594, 586; 53/452, 456, 461, 467; 229/101, 87.1, 103.2

(56) References Cited

U.S. PATENT DOCUMENTS 3,790,065 A * 2/1974 Carpenter ..... 206/424
3,871,572 A * 3/1975 Skaggs ..... 206/424
4,134,497 A * 1/1979 Dlugopolski ..... 206/521
4,538,737 A 9/1985 Delaney
4,557,455 A 12/1985 Benjamin
4,702,060 A 10/1987 Reid
4,759,446 A * 7/1988 Dobashi et al. ..... 206/594
4,865,200 A * 9/1989 Sullivan et al. ..... 206/594
5,172,818 A 12/1992 Mautino et al.
5,707,188 A 1/1998 Longstreet
5,803,267 A * 9/1998 Tu et al. ..... 206/591

* cited by examiner

*Primary Examiner*—Luan K. Bui
(74) *Attorney, Agent, or Firm*—J. Nevin Shaffer, Jr.

(57) ABSTRACT

In packaging for shipping material (26), a universal pack (10) for accommodating materials (26) of different sizes, includes a precut form (12) conformed to form a box (32) with more than one discontinuous side (14), a discontinuous bottom (16), one continuous side (18) and a continuous top (20). More than one extension (22) is connected to discontinuous bottom (16) and connectors (24) are attached to the more than one extension (22). Material (26) is inserted into box (32) and extensions (22) are secured around material (26) so that material (26) is secured against movement both side to side and front to back.

19 Claims, 4 Drawing Sheets

UNIVERSAL PACK APPARATUS AND METHOD

TECHNICAL FIELD OF THE INVENTION

This invention relates to packaging for shipping material. In particular, the invention relates to a universal pack for accommodating materials of different sizes in a single packaging product. The invention encompasses both a universal pack apparatus and a method for forming a universal pack.

BACKGROUND OF THE INVENTION

In businesses that ship material, products, to buyers, the cost of the shipping packaging is a source of constant tension. On one hand, businesses are motivated to keep the investment in packaging to a minimum. On the other hand, businesses are motivated to spend as much as necessary on packaging to ensure that the material reaches the buyer in good working order.

Packaging concerns for businesses are multiplied in businesses that ship materials of different sizes. A typical solution to the problem of providing adequate packaging for materials of different sizes is to provide custom packaging for each separate size of material. This is a costly and imperfect solution for businesses with any more than one or two differently sized materials.

Another typical solution is to provide packaging that is "adjustable" to accommodate material of different dimensions. The adjustability of this solution is provided by providing tear away sections of foam packaging. For example, a single package is provided with a minimum dimension for accommodating the smallest material to be shipped. If the material to be shipped is greater than the smallest dimension, sections of foam insert are torn away to provide a package receiving space of greater dimension. While this solution is less costly than custom packaging for each differently sized material to be shipped, it is not perfectly adjustable. That is to say, typically the foam inserts are precut in arbitrary dimensions such that the material to be shipped is either forced into a receiving area that is too small or allowed some range of motion in a receiving area that is too large. Needless to say, a great deal of experience and judgement are required to make this labor intensive system useful at all.

While there may be some packages wherein a perfect fit for shipping material is not required, many more situations exist wherein a perfect fit is not only desirable but essential in assuring that the shipped material reaches the buyer in good working order. By way of example but not limitation, the custom computer business demands that computers custom designed by buyers in an infinite variety of configurations reach the buyer in perfect condition. Additionally, computer providers have a need for receiving returned computer assemblies with the assurance that the return shipping has not caused more damage to the computer than the problem the buyer encountered on receipt.

Continuing with the computer example, it is known in the computer industry that computers undergo high gravitational force levels during shipping. This is a constant concern to shippers of delicate machinery of all types, since high G levels alone can damage the product. It is understood by businesses that packaging delicate machinery is like adjusting a spring, if the material being shipped is too heavy for the supporting packaging it will bottom out during shipment and cause damage to the material.

SUMMARY OF THE INVENTION

It is an object of the invention to provide a pack for accommodating material which overcomes the above-described problems and others associated with successfully and inexpensively shipping various sized materials, particularly computers and related products.

Accordingly, in packaging for shipping material, the universal pack for accommodating material of different sizes of the present invention includes a precut form conformed to form a box with more than one discontinuous side and a discontinuous bottom and one continuous side with a continuous top. More than one extension extends from the discontinuous bottom and connectors are provided on the more than one extension. In a preferred embodiment, the precut form includes three discontinuous sides and three extensions from the discontinuous bottom. In another aspect of the invention tear circles are provided at each of the more than one extension from the discontinuous bottom.

In another aspect of the invention, the connectors include a hook and loop material in combination. In a further aspect of the invention scoring is provided on the more than one extension. In still another aspect, the scoring is perpendicular to the more than one extension. In another embodiment, the more than one extension are conformed to secure material against both front and back as well as side to side movement within the box.

In another preferred embodiment of the invention, in corrugated cardboard packaging for shipping material, a universal pack system for accommodating different sized materials includes a unitary precut form conformed to form a box with three discontinuous sides and a discontinuous bottom and one continuous side and a continuous top. Three extensions are connected to, and extend from, the discontinuous bottom. Connectors are provided on the three extensions and are conformed to selectively secure the three extensions in place around material in the box. In one aspect of this invention, the three extensions extend beyond the three discontinuous sides when extended parallel to the discontinuous bottom.

In another preferred embodiment of the invention, a method of forming a universal pack for shipping materials of different sizes includes the steps of providing a precut form so that it forms a box with more than one discontinuous side and a discontinuous bottom and one continuous side and a continuous top. More than one extension is precut in the form extending from the discontinuous bottom. Connectors are attached to the more than one extension and material is inserted in the box. The material is encompassed by the more than one extension and the material is then secured within the box by connecting the more than one extension with the connectors once the more than one extension are in place around the material.

BRIEF DESCRIPTION OF THE DRAWINGS

Other objects, features and advantages of the present invention will become more fully apparent from the following detailed description of the preferred embodiment, the appended claims and the accompanying drawings in which:

DESCRIPTION OF THE PREFERRED EMBODIMENTS

Figure 1:
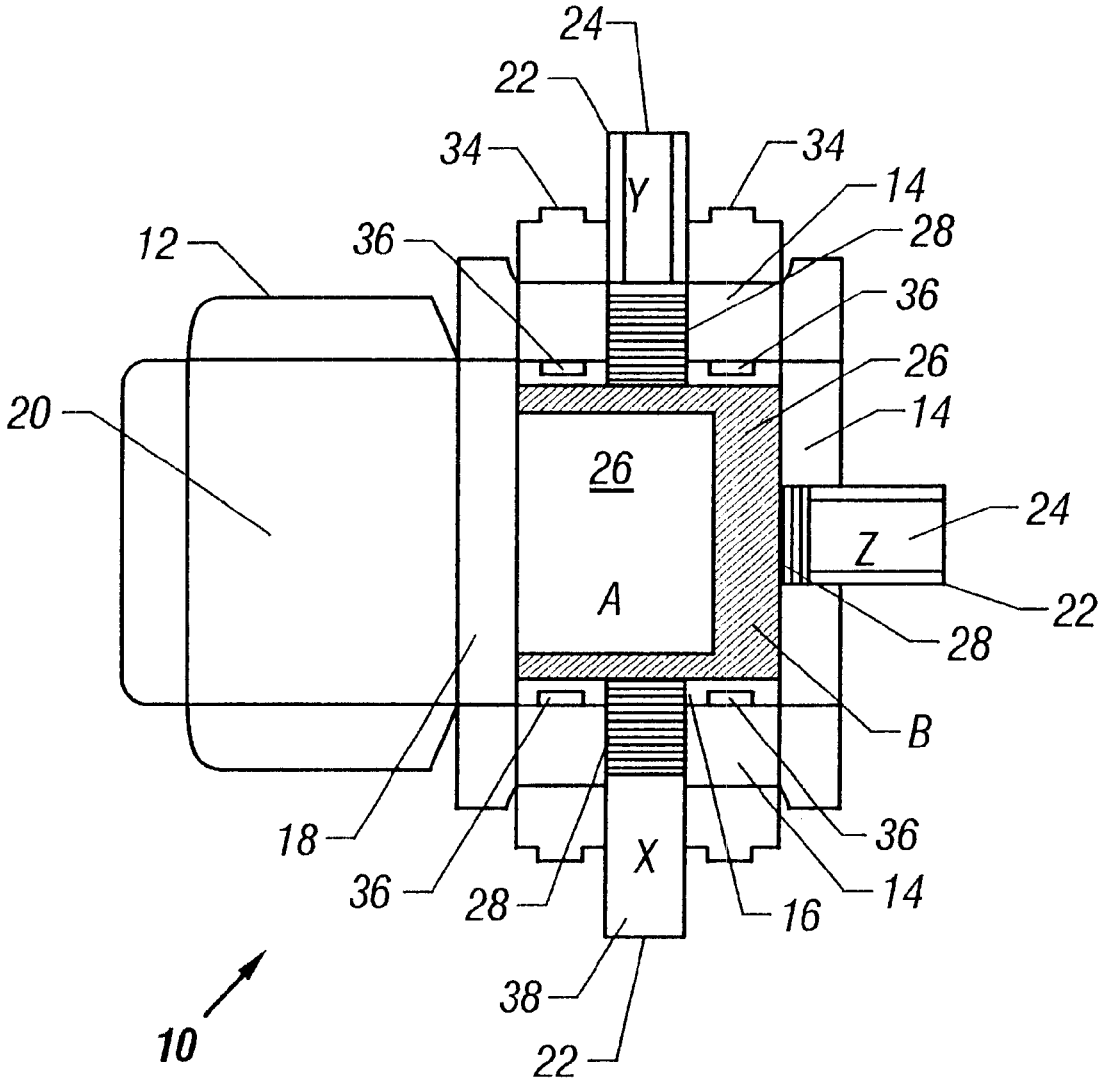
FIG. 1 is a top view of the inside of the universal pack of the present invention in its unfolded, flat, die cut form.

The preferred embodiments of the present invention are illustrated by way of example in FIGS. 1–4. With specific reference to FIGS. 1 and 2, universal pack 10 includes precut form 12 conformed to form a box, as more clearly illustrated in FIG. 3, with discontinuous sides 14, discontinuous bottom 16, continuous side 18 and continuous top 20. Extensions 22 extend from discontinuous bottom 16. Additionally, extensions 22 include connectors 24 as will be disclosed more fully hereafter.

Also illustrated is material 26 to be shipped. Two sizes of material 26 are illustrated, small size "A" and larger size "B". Scoring 28 in extensions 22 is also illustrated. Further, tear circles 30 are provided at the ends of extensions 22 where extensions 22 connect to discontinuous bottom 16.

Figure 2:
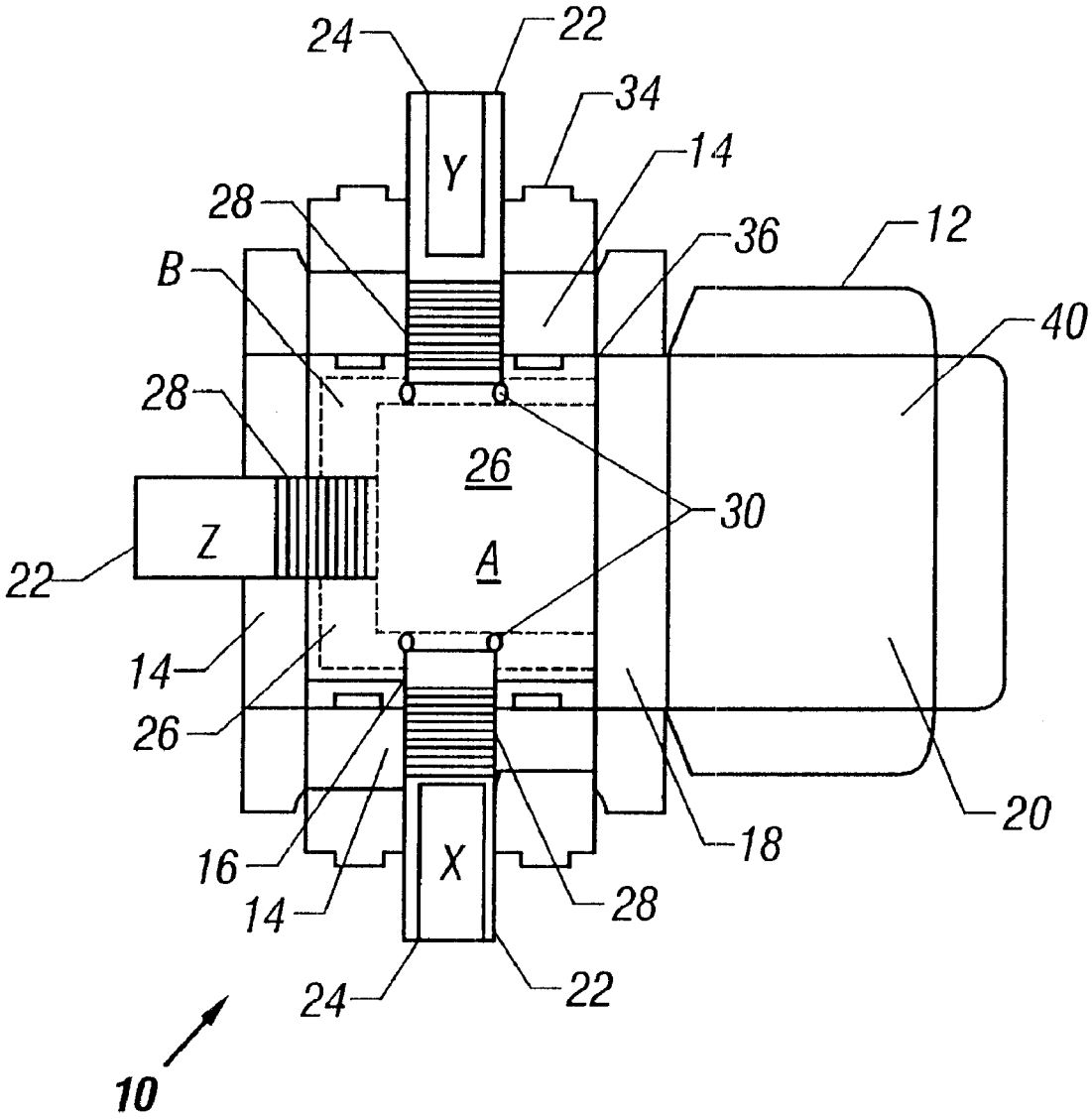
FIG. 2, is a top view of the outside of the invention disclosed in FIG. 1.
Figure 3:
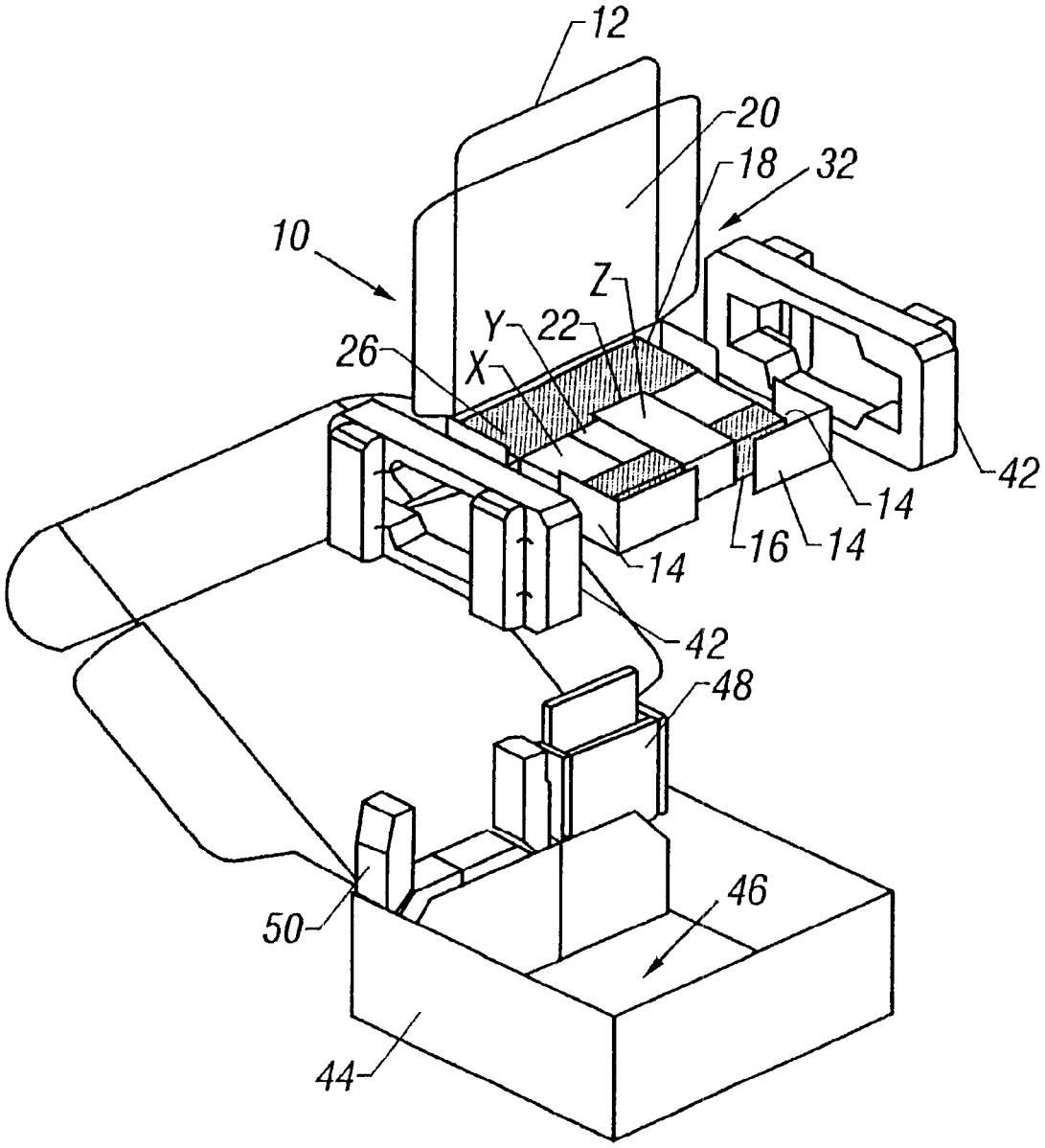
FIG. 3 is in isometric view of the universal pack of the present invention as illustrated in FIGS. 1 and 2 formed into a box with the continuous top open and shown in conjunction with other standard packaging elements.

Other than the scoring 28 lines shown on extensions 22, the dashed lines in FIGS. 1 and 2 show the fold lines, as known, in precut form 12 necessary to create the assembled box 32 as more clearly shown in FIG. 3. As is also known in the art, tabs 34 on discontinuous sides 14 cooperate with slots 36 to form completed discontinuous sides 14 of box 32.

As illustrated in FIGS. 1 and 2, extensions 22 extend beyond discontinuous sides 14 and discontinuous bottom 16 when precut form 12 is in the flat position illustrated. Further, in a preferred embodiment of the invention, extensions 22 have an inside 38, shown in FIG. 1, and an outside 40, shown in FIG. 2. In a preferred embodiment, connectors 24 are formed from hook and loop material with an appropriate combination of some hook material on the inside 38 of one extension 22, on the outside 40 of another extension 22, and on the inside 38 and outside 40 of another extension 22, as shown in the Figures. By way of further explanation, extensions 22 in FIGS. 1 and 2 have been labeled with the letters x, y, and z. As a result, it can be determined that extension 22 labeled x has no hook and loop material on the inside 38 but only on the outside 40. Extension 22 labeled y has hook and loop material on the inside 38 and the outside 40, and extension 22 labeled z has hook and loop material only on the inside 38 and not the outside 40.

Referring now to FIG. 3, precut form 12 is shown formed into box 32 with discontinuous sides 14 and discontinuous bottom 16. Further, the one continuous side 18 and continuous top 20, shown in the open position, are illustrated. Further, extensions 22 are shown in their folded, connected positions wherein connection 22 labeled x is first pulled snugly over material 26, connection 22 labeled y is then overlaid on top of x and connected thereto by connectors 24, for example hook and loop material, thereby securing material 26 against side to side motion within box 32. Finally, extension 22 labeled z is pulled snugly around material 26 forcing material 26 securely and snugly against continuous side 18, the back of the box 32, and held in place by connectors 24, such as hook and loop material, in combination with extensions 22 labeled x and y. As a result, material 26 is held in position against front and back movement within box 32 as well.

FIG. 3 illustrates the versatility of universal pack 10 in that a single precut form 12 provides secure packaging for an extraordinary variety of different size materials 26. At the same time, while box 32 accommodates essentially an infinite number of different size materials 26, the exterior dimensions of precut form 12 are standard and unchanging. That is to say, when precut form 12 is formed into box 32, discontinuous sides 14 do not change dimensions even while universal pack 10 accommodates materials 26 of varying sizes, "A" to "B". As a result, standardized foam end pieces 42, as is known in the art, of a single dimension are used to support universal pack 10 within exterior shipping box 44 as is known in the art. Exterior shipping box 44 provides a space 46 large enough to just accommodate end pieces 42 as well as additional computer products 48 and computer materials 50, again as is known in the art.

In use, universal pack 10 is created from a unitary precut form 12 by creating a die cut unitary form from some suitable packaging material such as, for example, cardboard. Importantly, extensions 22 are precut in discontinuous bottom 16 and include scoring 28. In a preferred embodiment, scoring 28 is perpendicular to the more than one extension 22 and enables extensions 22 to accommodate any variation in size of material 26 by allowing extensions 22 to easily bend and fold up and over and around material 26 so as to securely hold material 26 in position within box 32. Further, tear circles 30 are provided where extensions 22 are connected to discontinuous bottom 16. Since extensions 22 are formed by die cuts in discontinuous bottom 16, tear circles 30 prevent the die cuts from increasing in length due to the weight of material 26.

As used herein, the term "discontinuous" is meant to convey the fact that sides 14 and bottom 16 are cut through the sides 14 and bottom 16 where, by contrast, the rear side 18 and top 20 have no such breaks, cuts, or intrusions. As a result, side 18 and top 20 are called "continuous" in that, except for the normal fold lines, they are not cut or broken in any way. The fact that universal pack 10 has discontinuous sides 14 and a discontinuous bottom 16 provides an additional, unexpected, advantage in that while the discontinuous sides 14 are held within and supported by end pieces 42, a small amount of spring action is created when material 26 is secured as previously described. That is the cuts made in discontinuous bottom 16 and discontinuous sides 14 to form extensions 22 allow material 26 to move slightly more even when suspended in end pieces 42. It has been determined that this slight spring effect helps keep the G forces on the material 26 well below sixty. Box 32, however, is sufficiently rigid once formed to prevent excessive movement of material 26 provided by this added springlike effect of the discontinuous sides 14 and discontinuous bottom 16.

Figure 4:
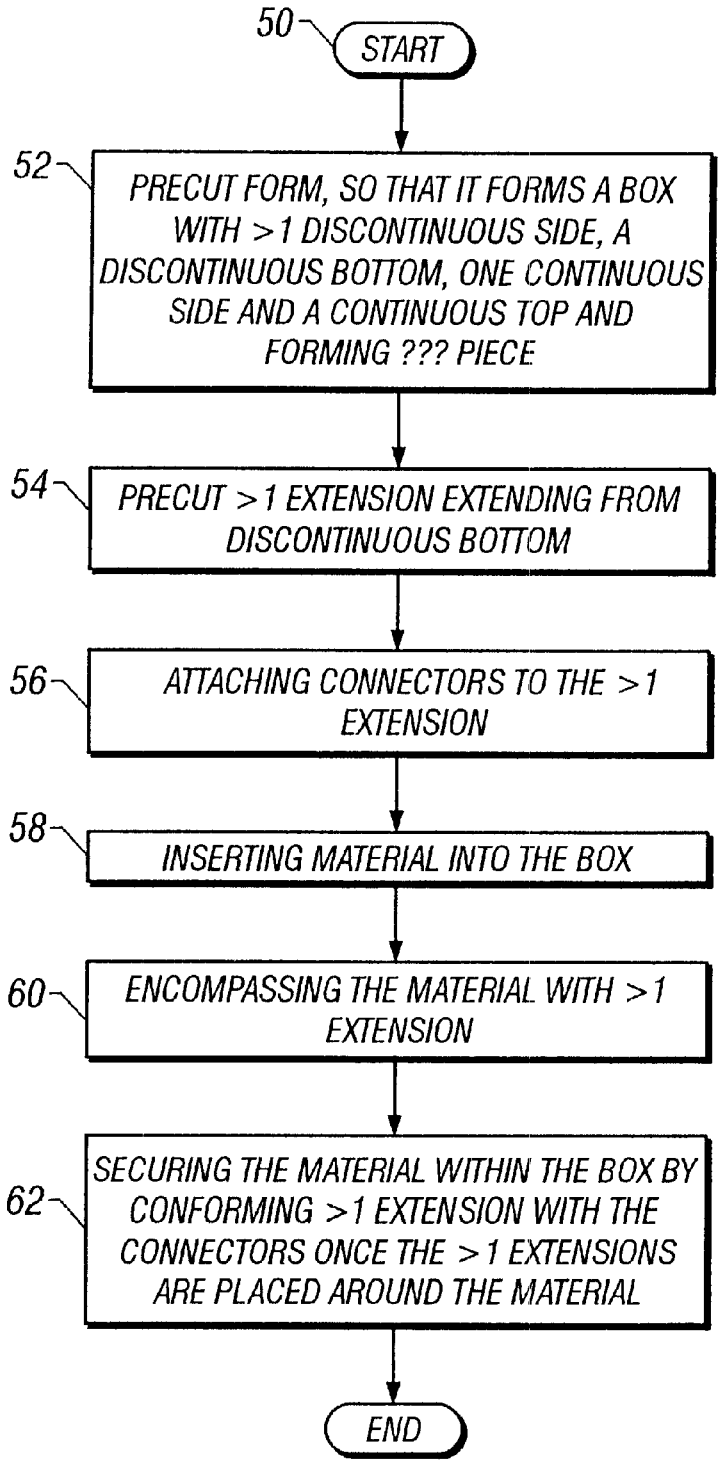
FIG. 4 is a flow diagram of the method of the present invention.

Referring now to FIG. 4, a method of forming a universal pack 10 for shipping materials 26 of various sizes starts in block 52 with the step of precutting a form 12 so that it forms a box 32 with more than one discontinuous side 14 and a discontinuous bottom 16 and one continuous side 18 and a continuous top 20. More than one extension 22 is precut in form 12, in step 54, such that extensions 22 extend from discontinuous bottom 16. At step 56, connectors 24 are attached to extensions 22. Next, in block 58, material 26 to be shipped is inserted into box 32. In block 60, extensions 22 are utilized to encompass the material 26 within box 32 and, in block 62, material 26 is secured within box 32 by connecting extensions 22 in place around the material 26.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiments thereof, it should be understood that there may be other embodiments which fall within the spirit and scope of the invention as defined by the following claims.

What is claimed is:

1. In packaging for shipping material, a universal pack for accommodating material of different sizes, the universal pack comprising:

a) a precut form conformed to form a box with more than one discontinuous side and a discontinuous bottom and one continuous side and a continuous top;

b) more than one extension from the discontinuous bottom;

c) connectors on the more than one extension; and d) tear circles at each of the more than one extension from the discontinuous bottom.

2. The universal pack of claim 1 wherein the precut form includes three discontinuous sides and three extensions from the discontinuous bottom.

3. The universal pack of claim 1 further comprising scoring on the more than one extension.

4. The universal pack of claim 1 wherein the connectors include hook and loop material in combination.

5. The universal pack of claim 3 wherein the scoring is perpendicular to the more than one extension.

6. The universal pack of claim 1 wherein the more than one extension are conformed to secure material against both front and back and side to side movement within the box.

7. In corrugated cardboard packaging for shipping material, a universal pack system for accommodating different sized materials, the universal pack system comprising:

a) a unitary precut form conformed to form a box with three discontinuous sides and a discontinuous bottom and one continuous side and a continuous top;

b) three extensions connected to and extending from the discontinuous bottom; and c) connectors on the three extensions conformed to selectively secure the three extensions in place around the material in the box.

8. The universal pack system of claim 7 wherein the three extensions extend beyond the three discontinuous sides when extended parallel to the discontinuous bottom.

9. The universal pack system of claim 7 wherein the connectors are hook and loop materials in combination.

10. The universal pack system of claim 7 wherein the three extensions have an inside and an outside and the connectors are attached to the inside of one extension, the outside of another extension and the inside and outside of another extension.

11. The universal pack system of claim 10 wherein the connectors are hook and loop material attached to the upper sides and to the lower sides in cooperating combination.

12. The universal pack system of claim 7 wherein the three extensions include scoring.

13. The universal pack system of claim 10 further comprising scoring wherein the scoring is perpendicular to the three extensions on the insides of the three extensions.

14. The universal pack system of claim 7 further comprising tear circles at the connection of each of the three extensions to the discontinuous bottom.

15. A method of forming a universal pack for shipping material of different sizes, the method comprising the steps of:

a) precutting a form so that it forms a box with more than one discontinuous side and a discontinuous bottom and one continuous side and a continuous top;

b) precutting more than one extension in the form extending from the discontinuous bottom;

c) attaching connectors on the more than one extension;

d) inserting material in the box;

e) encompassing the material with the more than one extension; and f) securing the material within the box by connecting the more than one extension with the connectors once the more than one extension is in place around the material.

16. The method of claim 15 wherein step b) comprises precutting three extensions in the form extending from the discontinuous bottom.

17. The method of claim 15 wherein step c) comprises attaching hook and loop material to the more than one extension.

18. The method of claim 15 wherein step d) comprises inserting the material into the box against the one continuous side.

19. The method of claim 15 further comprising the step of scoring the more than one extension.

* * * * *

UNITED STATES PATENT AND TRADEMARK OFFICE

CERTIFICATE OF CORRECTION

PATENT NO. : 6,622,860 B2
DATED : September 23, 2003
INVENTOR(S) : John Alexander Horbal It is certified that error appears in the above-identified patent and that said Letters Patent is hereby corrected as shown below:

Title page,
Item [73], Assignee: add -- Assignee: Dell Products, L.P. --.

Signed and Sealed this

Sixth Day of July, 2004

JON W. DUDAS
*Acting Director of the United States Patent and Trademark Office*